US010710142B2

(12) United States Patent
Gearhart et al.

(10) Patent No.: US 10,710,142 B2
(45) Date of Patent: Jul. 14, 2020

(54) LUBRICATION-FREE SEALING DEVICE FOR NECKING MACHINERY

(71) Applicant: BELVAC PRODUCTION MACHINERY, INC., Lynchburg, VA (US)

(72) Inventors: Brian S. Gearhart, Huddleston, VA (US); Stephen C. Burnette, Lynchburg, VA (US)

(73) Assignee: BELVAC PRODUCTION MACHINERY, INC., Lynchburg, VA (US)

( * ) Notice: Subject to any disclaimer, the term of this patent is extended or adjusted under 35 U.S.C. 154(b) by 163 days.

(21) Appl. No.: 15/745,164

(22) PCT Filed: Jul. 12, 2016

(86) PCT No.: PCT/US2016/041868
§ 371 (c)(1),
(2) Date: Jan. 16, 2018

(87) PCT Pub. No.: WO2017/019291
PCT Pub. Date: Feb. 2, 2017

(65) Prior Publication Data

US 2018/0207705 A1 Jul. 26, 2018

Related U.S. Application Data

(60) Provisional application No. 62/198,915, filed on Jul. 30, 2015.

(51) Int. Cl.

| | |
|---|---|
| ***B21D 51/26*** | (2006.01) |
| ***B21D 45/06*** | (2006.01) |
| *B21D 22/20* | (2006.01) |

(52) U.S. Cl.
CPC ..... *B21D 45/065* (2013.01); *B21D 51/26* (2013.01); *B21D 51/2638* (2013.01); *B21D 22/20* (2013.01)

(58) Field of Classification Search
CPC ..... B21D 51/2646; B21D 51/2638; B21D 51/2669; B21D 51/2692; B21D 51/2615; B21D 51/2623; B21D 51/51; B21D 51/10
See application file for complete search history.

(56) References Cited

U.S. PATENT DOCUMENTS

| | | | |
|---|---|---|---|
| 4,280,353 | A | 7/1981 | Murphy |
| 4,519,232 | A | 5/1985 | Traczyk |

(Continued)

FOREIGN PATENT DOCUMENTS

| | | | |
|---|---|---|---|
| CN | 1207063 | A | 2/1999 |
| CN | 201572836 | U | 9/2010 |

(Continued)

OTHER PUBLICATIONS

International Search Report from International Application No. PCT/US2016/041868 dated Oct. 27, 2016.

*Primary Examiner* — Pradeep C Battula
(74) *Attorney, Agent, or Firm* — Nixon Peabody LLP

(57) ABSTRACT

Presented herein are container forming machines, forming ram assemblies, and methods for making and for using forming ram assemblies. A forming ram assembly is presented for a container forming machine, which includes a turret assembly with a cam rail. The ram assembly includes a mounting rail for attaching to the turret assembly. A cam follower is mounted to the mounting rail and configured to rollably seat against the cam rail. Connected to the cam follower is a forming die which moves as the cam follower traverses the cam rail. A knockout tool is mounted inside the forming die and includes a stepped segment. A drive cylinder moves the knockout tool within the forming die. An (Continued)

O-ring is seated inside a complementary channel of the knockout tool. An annular knockout guide is seated on the stepped segment of the knockout tool, located between and abutting the O-ring and forming die.

20 Claims, 6 Drawing Sheets

(56) References Cited

U.S. PATENT DOCUMENTS

| | | | | |
|---|---|---|---|---|
| 10,166,591 | B2 * | 1/2019 | Babbitt | B21D 51/2692 |
| 2005/0252264 | A1 * | 11/2005 | Shuey | B21D 51/2615 72/126 |

FOREIGN PATENT DOCUMENTS

| | | | |
|---|---|---|---|
| CN | 202893985 | U | 4/2013 |
| CN | 204486618 | U | 7/2015 |
| GB | 2179284 | A | 3/1987 |
| WO | 2013070199 | A1 | 5/2013 |

* cited by examiner

LUBRICATION-FREE SEALING DEVICE FOR NECKING MACHINERY

CROSS-REFERENCE TO RELATED APPLICATION(S)

This application is a U.S. National Stage of International Application No. PCT/US2016/041868, filed on Jul. 12, 2016, which claims priority to U.S. Provisional Patent Application No. 62/198,915, filed Jul. 30, 2015, both of which are hereby incorporated by reference herein in their entireties.

TECHNICAL FIELD

The present disclosure relates generally to systems, methods and devices for forming or processing an article of manufacture. More particularly, aspects of this disclosure relate to knockout ram assemblies for forming machines used in necking operations for shaping containers, such as bottles and cans.

BACKGROUND

In the container manufacturing industry, various approaches exist for fabricating and processing different container constructions, including bottles, cans and jars. For example, ram assemblies may be used to position and to shape a container that is being processed in a curling, cutting, expanding, necking, or other forming operation. Conventional ram assemblies comprise a cylindrical ram (piston), which moves axially relative to a turret shaft, and a plain bushing (housing), which is mounted to the turret shaft. The ram is moved, for example, by a turret barrel cam, in a reciprocating motion through the bushing. Historically, turret assemblies have operated by one ram assembly pushing a can, e.g., at a closed end of the can, into a forming head on a machine. A second, separate ram assembly then pushes a forming tool into or onto the can, e.g., at an open end of the can, to perform a forming operation.

Metal cans are often produced as "two piece" constructions, which consist of a cylindrical can body with an integral bottom wall and a can top. These cans are generally fabricated from thin aluminum or steel sheet metal. Aluminum cans, for example, are oftentimes used to package gas-pressurized liquids, such as beer and soda. For such applications, the can must exhibit a minimum predetermined strength so that it can withstand internal gas pressures generated by its contents, as well as the external forces from stacking, packaging and shipping, dispensing from machines, and handling of the can. However, the thickness of the sheet metal is a significant contributor to the overall cost of manufacturing such cans. If the thickness of the sheet metal can be reduced, while complying with strength requirements and other manufacturing tolerances, the cans can be produced at a decreased cost.

An example of a machine that forms the shape of the can body is known as a "necker" apparatus. Conventional neckers operate by applying mechanical pressure to the can body after it has been formed into its general body shape, e.g., a cylinder or multi-angular shape with an integral bottom wall. The necker is a type of tool-and-die apparatus in which the sheet metal is placed between a tool, having a protrusion, and a die, having a matching indentation. The tool and die are brought together, under pressure, forcing the sheet metal to assume the shape of the protrusion-indentation. A BELVAC™ (Belvac Product Machinery, Inc.) 595 Shaped Can Necker, for example, can form can bodies at speeds of up to approximately 2500 cans per minute. Can bodies are squeezed ("necked") between opposite moving ram assemblies, namely a series of push rams which act as tools and an opposite series of knockout rams which act as dies. The can bodies, as they are progressed through the machine, are rapidly squeezed between a first pair of push and knockout rams, then a second pair of push and knockout rams, for as many as six or eight or more pairs of rams to complete the "necking" operation.

Each of the rams reciprocates back and forth at high speeds and with a relatively short travel distance of, for example, approximately 1-3 inches. Conventional necking rams are mechanically actuated, for example, by a "cam" mechanism, as air pressure actuators and electromechanical solenoid systems are oftentimes too fragile for the required high pressures and speeds and extreme shock loading. A cam is an elongated, raised rail with an oscillating (sinusoidal) track; each ram piston carries, at its rear end, wheels that fit on opposite sides of the cam track. As the cam track turns, it pulls and pushes the wheels of the ram causing the piston to move forward and backward. In addition to speed and travel, piston alignment is critical to ensure that the rams move with an exact timing and without binding. If a ram jams or becomes worn, it may fail and hold up the entire can production system. For that reason, rams are carefully lubricated, regularly inspected and, when necessary, replaced. Many modern machines use automatic lubrication, which typically involves running grease tubes to each ram assembly. For ram assemblies that are attached to a rotating turret, a special coupling for the grease supply line is necessary to distribute the grease to each ram. These couplings can wear out with time and use, allowing grease to escape. Even with proper lubrication, the rams may have to be inspected and replaced every few weeks, which is a large expense in terms of parts, machine down-time, time of skilled labor, and scrapped cans.

For some die neck progressions, the knockout (also known as a "knockout tool") strokes thru the stationary die (also known as a "forming die") to add support to the open end of a can during the reduction process. In addition to neck support, the knockout allows compressed air to enter the can to stabilize can position on a dome push plate, as well as to prevent the can from collapsing throughout the operation. A critical feature of a conventional ram assembly is an O-ring that is positioned on the outer diameter (OD) of the knockout. These O-rings aide in centering the knockout inside the stationary die to maintain consistent tool gaps, while allowing "float" for mobility with variations in incoming can wall thickness. The O-ring also helps to seal compressed air at the rear of the knockout, e.g., to prevent inadvertent venting, while maintaining maximum process support and minimizing utility requirements. O-rings also help to prevent grease, dirt and other contaminants common to neckers from entering the tooling thru the rear of the knockout proximate the tooling ram (also known as a "drive cylinder"). O-rings are typically staged in a dynamic setup with high-speed reciprocating motion and limited cross-sectional squeeze. In addition, the only lubrication an O-ring will typically see is residual mineral oil or wax used on the can for necking. As such, O-ring operational life expectancy is minimal and, thus, must be replaced on a regular basis to maintain function. This increases parts and labor costs which, in turn, increase overall manufacturing costs.

SUMMARY

Disclosed herein are container forming machines, knockout ram assemblies, and methods for necking containers, such as bottles and cans. By way of example, a forming ram assembly is disclosed which includes an annular PTFE-based knockout guide that provides knockout support relative to the forming die. The knockout guide is captured between a front face of a ram and a rear face of a knockout tool, press-fit against the inside diameter (ID) of a die. With this arrangement, mechanical fasteners and adhesives, while optional, are not required to maintain position of the knockout guide. The knockout guide is seated on a complementary step at the rear of the knockout tool, positioned on top of the O-ring, which helps to minimize compressed air loss and prevent contaminants from entering through the back of the tooling set. The knockout guide can be "stage-specific," i.e., sized to run inside the die, and provided with an optional forward-facing approximately 45-degree ramped OD leading edge to ensure that the knockout guide remains in constant contact with the ID relief surface of the die. Extending continuously around the circumference of the knockout guide, e.g., along leading and trailing ID edges, are optional chamfered corners that help to simplify mounting of the guide onto the knockout tool. In this assembly, the knockout guide operates as the dynamic wear component for reciprocating motion of the knockout with respect to the die. With use of PTFE or other wear-resistant, friction-reducing polymeric materials, the operational life expectancy of the knockout guide will greatly exceed that of a standard O-ring in the same application. The O-ring can be positioned against the ID of the knockout guide, which allows the knockout to float within the tooling assembly. The O-ring, however, is implemented as a "static application" and, thus, will not wear as significantly from the necking process.

Aspects of the present disclosure are directed to automated forming machines for processing articles of manufacture. In an embodiment, a forming apparatus for modifying the shape of a container is presented. This forming apparatus includes, for example, a frame with a first base and a second base, and a drive shaft extending from the first base to the second base. A turret starwheel is coaxially mounted with the drive shaft and configured to receive and move the container during forming. Coaxially mounted with the drive shaft is a turret assembly with an elongated cam rail. A forming ram assembly is connected to the turret assembly. This forming ram assembly includes a cam follower that is rollably seated against the elongated cam rail. Connected to the cam follower is a forming die which moves in a reciprocating manner as the cam follower traverses the elongated cam rail. A knockout tool, which is movably mounted inside the forming die, includes an outer surface with a stepped segment. Connected to the knockout tool is a drive cylinder that is operable to move the knockout tool in a reciprocating manner relative to the forming die. An O-ring is seated inside a complementary channel defined in the stepped segment of the knockout tool. A knockout guide is seated on the stepped segment of the knockout tool, abutting the O-ring and the forming die to thereby generally fluidly seal the knockout tool with the forming die while allowing the two dies to move relative to one another.

Other aspects of the present disclosure are directed to ram assemblies for forming machines used in processing articles of manufacture. In an embodiment, a knockout ram assembly for a container forming machine is presented. This ram assembly includes, for example, a mounting rail that is configured to attach the forming ram assembly to a turret assembly of the container forming machine. A cam follower is movably mounted to the mounting rail and configured to rollably seat against a cam rail of the turret assembly. Connected to the cam follower is a cylindrical forming die. By connecting the two components, the cylindrical forming die moves in a reciprocating manner in response to the cam follower traversing the cam rail. Movably mounted inside the cylindrical forming die is a cylindrical knockout tool. The knockout tool includes an outer diameter (OD) surface with a stepped segment. A drive cylinder is connected to the cylindrical knockout tool and configured to move the knockout tool in a reciprocating manner within the cylindrical forming die. Seated inside a complementary channel defined in the stepped segment of the knockout tool is an O-ring. An annular knockout guide is seated on the stepped segment of the knockout tool, located between and abutting the O-ring and the forming die. This arrangement helps to generally fluidly seal the knockout tool with the forming die while allowing the two dies to move relative to one another. In addition, the operational life expectancy of the O-ring is increased and the need for lubricant is significantly decreased or otherwise eliminated.

Also disclosed are methods for making and methods for using ram assemblies for shaping an article of manufacture. In an embodiment, a method of assembling a forming ram assembly for a container forming machine is presented. This method includes, in any order and in any combination with any other hereinafter disclosed steps and features: connecting a forming die to a cam follower, the cam follower being configured to rollably seat against and traverse a cam rail of the container forming machine to thereby move the forming die; slidably mounting a knockout tool inside the forming die; connecting to the knockout tool a drive cylinder that is configured to move the knockout tool within the forming die; mounting an O-ring onto the knockout tool; and, seating a knockout guide on a stepped segment of the knockout tool such that the knockout guide presses against the O-ring and the forming die to thereby fluidly seal the knockout tool with the forming die while allowing the two dies to move relative to one another.

The above summary does not represent every embodiment or every aspect of the present disclosure. Rather, the foregoing summary merely provides an exemplification of some of the novel aspects and features set forth herein. The above features and advantages, and other features and advantages of the present disclosure, which are considered to be inventive singly or in any combination, will be readily apparent from the following detailed description of the illustrated examples and the modes for carrying out the present invention when taken in connection with the accompanying drawings and the appended claims

Figure 1:
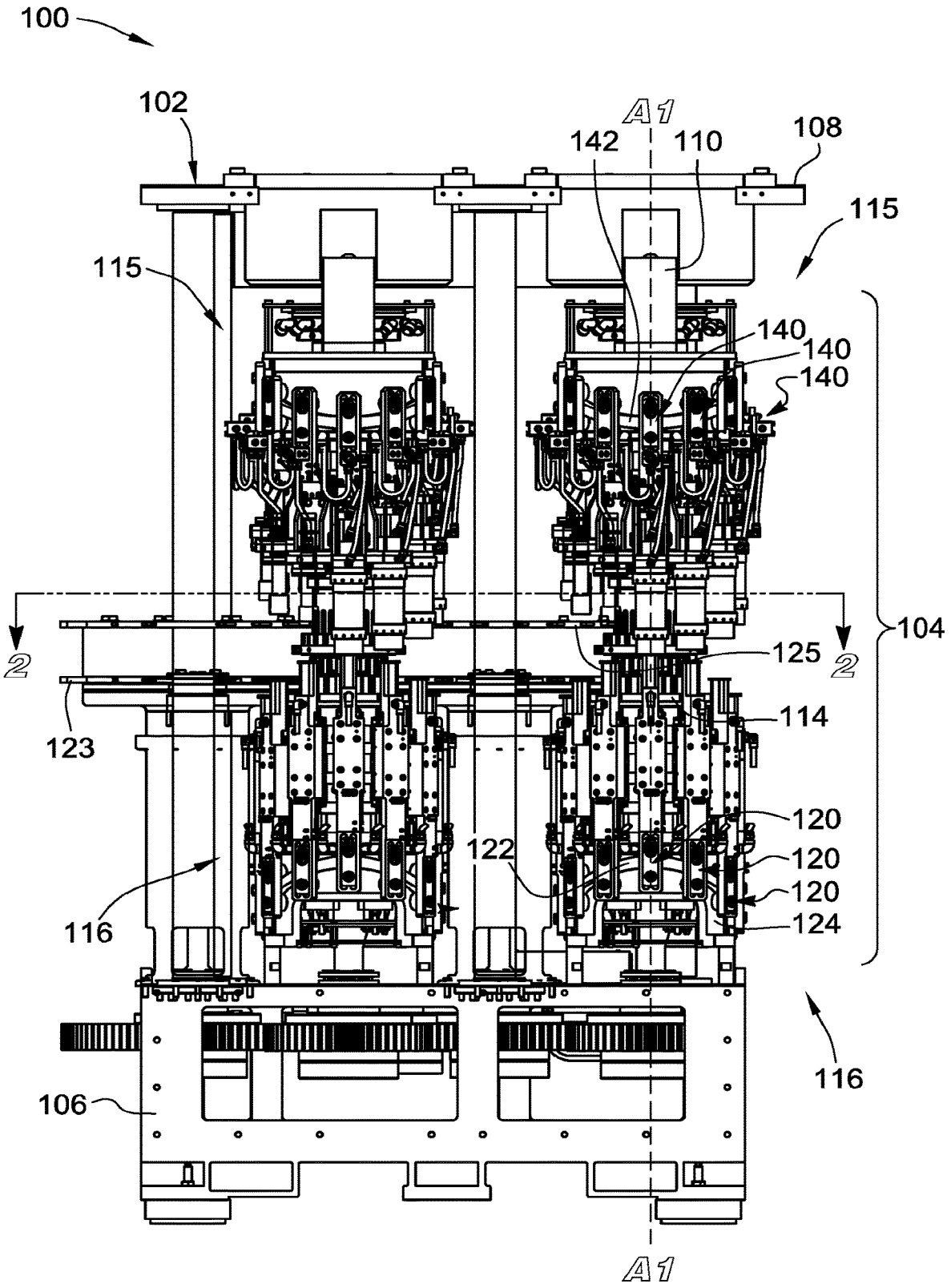
FIG. 1 is a front-view illustration of a representative container forming apparatus in accordance with aspects of the present disclosure.

The present disclosure is susceptible to various modifications and alternative forms, and some representative embodiments have been shown by way of example in the drawings and will be described in detail herein. It should be understood, however, that the inventive aspects are not limited to the particular forms illustrated in the drawings. Rather, the disclosure is to cover all modifications, equivalents, and alternatives falling within the spirit and scope of the invention as defined by the appended claims.

DETAILED DESCRIPTION OF ILLUSTRATED EXAMPLES

This disclosure is susceptible of embodiment in many different forms. There are shown in the drawings, and will herein be described in detail, representative embodiments with the understanding that the present disclosure is to be considered as an exemplification of the principles of the present disclosure and is not intended to limit the broad aspects of the disclosure to the embodiments illustrated. To that extent, elements and limitations that are disclosed, for example, in the Abstract, Summary, and Detailed Description sections, but not explicitly set forth in the claims, should not be incorporated into the claims, singly or collectively, by implication, inference or otherwise. For purposes of the present detailed description, unless specifically disclaimed or logically prohibited: the singular includes the plural and vice versa; and the words "including" or "comprising" or "having" means "including without limitation." Moreover, words of approximation, such as "about," "almost," "substantially," "approximately," and the like, can be used herein in the sense of "at, near, or nearly at," or "within 3-5% of," or "within acceptable manufacturing tolerances," or any logical combination thereof, for example.

Referring now to the drawings, wherein like reference numerals refer to like features throughout the several views, there is shown in FIG. 1 a representative forming machine, designated generally at 100, for modifying the shape of an article. The representative forming machine 100 illustrated in the drawings is an automated "rotatable" necking apparatus for shaping metallic beverage containers, such as aluminum cans and bottles. It should be readily understood that the forming apparatus 100 presented in FIG. 1 is merely provided as an exemplary application by which the various inventive aspects and features of this disclosure can be applied. As such, the novel features and aspects disclosed herein can be applied in other forming machines to perform other forming operations on any of an assortment of different articles of manufacture. Moreover, only selected components of the automated forming machine 100 have been shown and will be described in additional detail hereinbelow. Nevertheless, the systems, devices and assemblies discussed herein can include numerous additional and alternative features, and other well-known peripheral components, for example, for carrying out the various methods and functions disclosed herein without departing from the intended scope of this disclosure.

Forming machine 100 is used to form, process, or otherwise perform a manufacturing operation on a container such that the shape of the container is modified from a first shape to a second shape. In a multi-stage line, a container is first fed into a first stage (e.g. a rotatable forming apparatus) to enter pockets in a spinning turret/starwheel. Each starwheel may have any number of pockets to hold containers for processing and transfer. For example, a starwheel may have six, eight, ten, twelve, fourteen, etc., pockets to hold six, eight, ten, twelve, fourteen, etc., containers, respectively, at a given time. A starwheel is capable of having a single pocket or, more commonly, any number of pockets suitable for the intended application. After exiting the first stage, the container may enter a second stage, then on to a third stage, and so forth, depending on the configuration of the multi-stage line. Once fed into the multi-stage line, the container is processed through any number of stages, e.g. a necking stage, a curling stage, an expansion stage, or any other suitable processing or forming stage. When the container passes through all process/forming stages, the container is discharged from the machine. The multi-stage line may be a recirculating system or an in-line system, for example.

Figure 2:
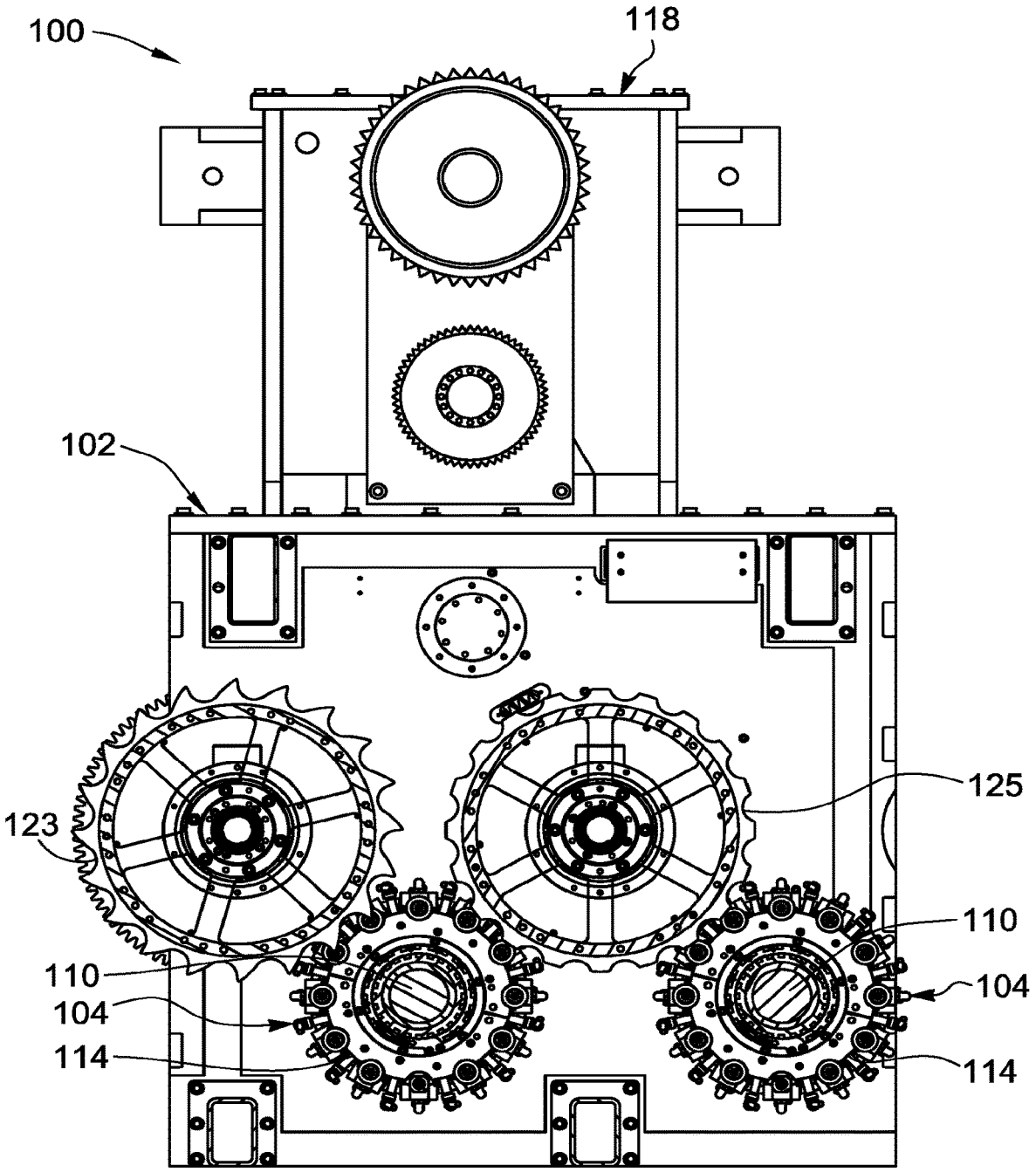
FIG. 2 is a cross-sectional plan-view illustration of the container forming apparatus of FIG. 1 taken along line 2-2.

Forming machine 100, as shown, includes a rigid outer frame 102 stowing therein one or more forming turret assemblies, two of which are visible but only one of which is designated 104 in FIG. 1. The frame 102 includes a first (lower) base 106 and a second (upper) base 108. Each forming turret assembly 104 includes a drive shaft 110, a turret starwheel 114, a first (fixed) turret 116 with plural push ram assemblies 120, and a second (movable) turret 115 with plural forming ram assemblies 140. The fixed turret 116 may be referred to as a "push ram block" while the moveable turret 115 may be referred to as a "forming ram block" or "axially adjustable turret portion." According to the illustrated example, the drive shaft 110 extends in a vertical direction (e.g., perpendicular to the ground), along a longitudinal axis A1-A1 of the forming turret assembly 104, from the lower base 106 to the upper base 108 of the outer frame 102. The drive shaft 110 can connect to the lower and upper bases 106, 108 via any suitable connectors, including bearings, couplings, gears, etc. As shown, the drive shaft 110 supports both the fixed turret 116 and the moveable turret 115 for common rotation therewith. The drive shaft 110 may be driven by any suitable means, including a motor-driven gear mechanism 118, which is best seen in FIG. 2. Elongated, oscillating cam rails, 122, 142 (or "cams" for short) connect to a base support 124 located concentric to the drive shaft 110. Rotation of the drive shaft 110 causes reciprocating and satellite motion of ram assemblies 120, 140 while interceding with the cams 122, 142. For some configurations, 270 degrees of each cam 122, 142 are used for the forming operation in each stage.

The central, longitudinal axis of the fixed turret 116 extends in the vertical direction, generally parallel to and concentrically aligned with the drive shaft 110. Fixed turret 116 is "fixed" in that the orientation (e.g. bottom line) of each container that enters and exits the forming machine 100 relative to the infeed and discharge conveying system, which helps move the containers through all stages of the rotatable forming machine 100, does not change. This typically allows for easier setup and control of the forming operation. For at least some optional configurations, the push ram assemblies 120 may be movably mounted to the movable turret 115 while the forming ram assemblies 140 may be movably mounted to the fixed turret 116. Moreover, the number of ram assemblies 120, 140 mounted to a turret 115, 116 can be varied from that which is shown in the drawings.

As best seen in FIG. 2, each of the turret starwheels 114 is coaxial with a respective drive shaft 110, and configured to receive containers from an infeed starwheel 123 or a transfer starwheel 125. Transfer starwheels 125 receive containers from a turret starwheel of a first stage process turret (e.g., the left-most forming turret assembly 104 in FIG. 2), and feed the containers to a turret starwheel of a next stage process turret (e.g., the right-most forming turret assembly 104 in FIG. 2). The turret starwheel 114 may have any suitable number of container compartments or "pockets" (e.g., six, eight, ten, twelve, etc.). In the same vein, the turret starwheel 114 may have any suitable number of components (e.g., six, eight, ten, twelve, etc.) that a push ram assembly holds and may push the container into a forming ram assembly in order to change the form/shape of the container. A forming ram assembly may take on various forms, including a die ram assembly or an expander ram assembly. The die ram assembly may neck the container while the expander ram assembly may expand the shape of the container.

Also extending in the vertical direction is the central, longitudinal axis of the movable turret 115, which is concentrically aligned with the drive shaft 110 and the fixed turret 116. Multiple forming ram assemblies 140 are mounted to and circumferentially spaced around the moveable turret 115. Each forming ram assembly 140 communicates with a cam 142 that circumscribes drive shaft 110, and is oriented by a key connection with an upper bearing housing. Rotation of the drive shaft 110 causes the moveable turret 115 to rotate which, in turn, causes the forming ram assemblies 140 to rotate around the cam 142. Moveable turret portion 115 may include a mechanical adjustment mechanism for adjusting the positioning of the turret portion 115 in the vertical direction along the drive shaft 110 with respect to the fixed turret 116 so as to configure the forming turret assembly 114 for containers of different lengths.

Figure 3:
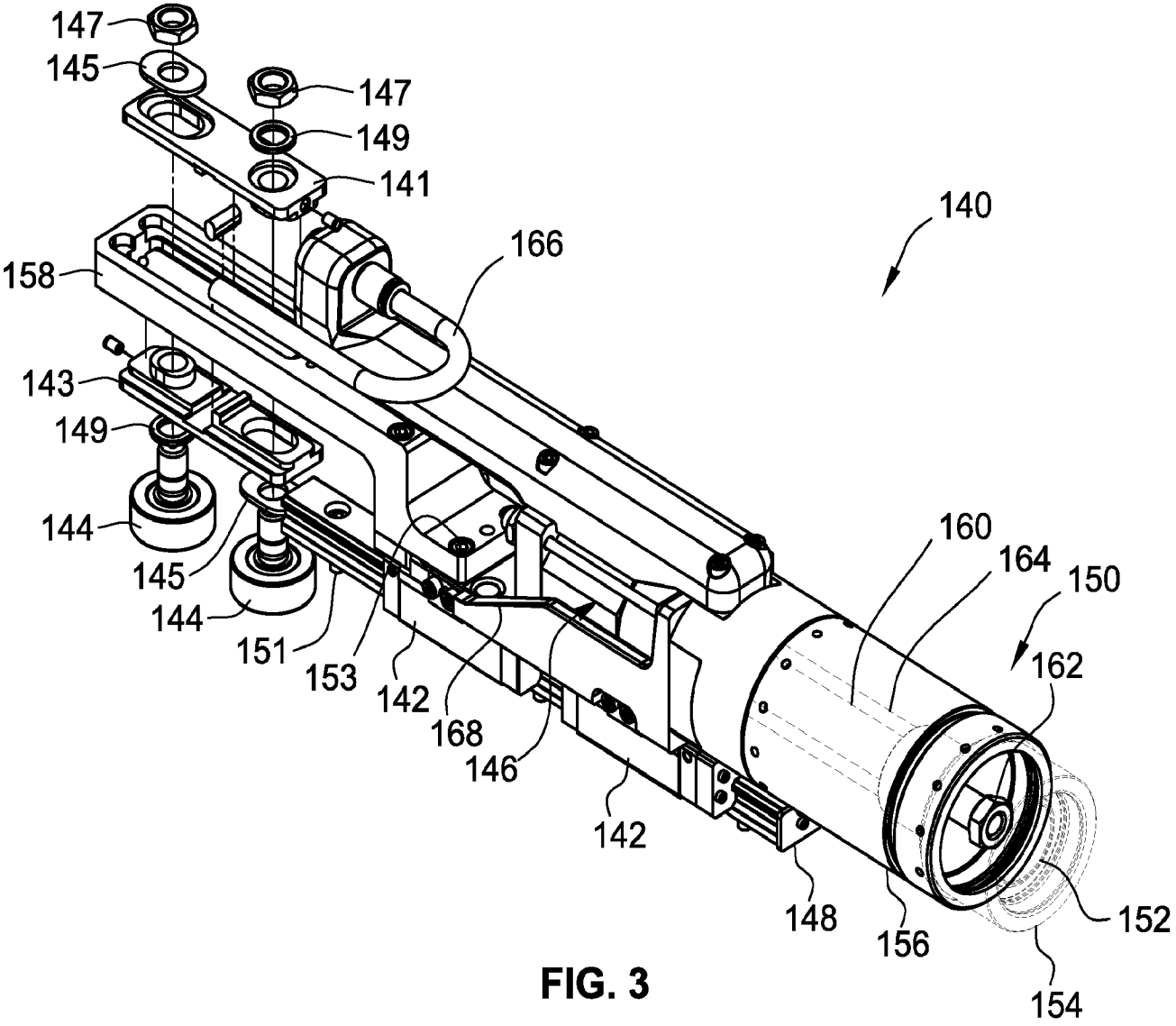
FIG. 3 is a partially exploded perspective-view illustration of a representative forming ram assembly with a forming die and knockout in accordance with aspects of the present disclosure.

As seen in FIG. 3, each of the forming ram assemblies 140 includes one or more slide blocks 142 with a profiled rail 148 extending through each slide block 142. A drive cylinder 146 is operable to slide each of the slide blocks 142 along the profiled rail 148, e.g., in the vertical direction. Each of the slide blocks 142 includes ball bearings (not visible in the view provided), which allow the slide blocks 142 to slide along the profiled rail 148 such that the forming ram assembly 140 moves up and down in the vertical direction with respect to the fixed turret 116 and the moveable turret 115. The forming ram assembly 140 may include a single slide block or, as shown, multiple slide blocks 142 to allow the forming assembly 100 to provide for a longer stroke distance of the forming ram assembly 140, as well as to increase the stability and life of the forming ram assembly. The profiled rail 148 (also referred to herein as "mounting rail") couples the forming ram assembly 140 to the moveable turret 115 via mechanical connectors (e.g., bolts 151). The rail 148 is cut or formed into a "profiled" shape, for example, to have a rectangular cross-section with peripheral grooves or ridges, a rounded profile, or a combination of rounded curves and angular or flat portions.

With continuing reference to FIG. 3, each of the forming ram assemblies 140 also includes a stepped adapter arm 158 that is coupled to a bracket 168, which is attached on an underside thereof to the slide blocks 142. A distal end of the adapter arm 158, which is the end opposite that of the knockout and forming die subassembly 150, includes provisions, such as polymeric grommets 141 and 143, bushings 145, hexagonal nuts 147, and washers 149, for mounting the cam followers 144 to the ram assembly 140. Each cam follower 144 is in sliding and/or rolling engagement with a respective side of the elongated cam rail 142, traversing the oscillating profile of the cam 142 as the forming ram assembly 140 rotates with the turret 115 around the cam 142 while the cam 142 is held stationary. A proximal end of the adapter arm 158, which is the end closest the knockout and forming die subassembly 150, includes provisions, such as bolts 153, for mounting to the bracket 168 and, thus, to the slide blocks 142. The rotation of the moveable turret 115 and the interaction between the cam followers 144 and the cam 142 causes the slide blocks 142 to slide along the profiled rail 148 with respect to the drive shaft 110.

Forming ram assemblies 140, once assembled with tooling components, each includes a drive cylinder 146, a knockout tool 152 (or "knockout" for short), and a forming die 154. In the illustrated example, the drive cylinder 146, which may be referred to as a knockout cylinder, takes on the form of a pneumatic cylinder actuator. The drive cylinder 146 may move in a downward vertical direction due to gravity and airline pressure variation due to air path resistance. The drive cylinder 146 receives airline pressure variation from an air manifold assembly that fixes to and rotates with the drive shaft 110. Once a container contacts the knockout tool 152, the drive cylinder 146 moves in the vertical direction that results from the forming die following the cam 142, thereby allowing the container to go over the knockout tool 152 while forming of the container occurs. Pressure is kept inside the container while forming occurs to help with the forming operation.

The forming die 154 is coupled to the cam followers 144, e.g., via adapter arm 158 and bracket 168, such that the forming die 154 moves in the vertical direction and satellite rotation to follow the cam 142 profile. For some embodiments, the forming dies 154 of each forming ram assembly 140 for a particular moveable turret 115 may all be the same, for example, in an in-line system. Comparatively, the forming dies 154 of some forming ram assemblies 140 may differ from the ram assemblies 140 of other moveable turrets 115 in the rotatable forming apparatus 100 such that the shape of a container is altered a first way by a first movable turret 115 and is altered a second way by a second moveable turret 115 with which the container interacts. In a recirculating system, the forming dies 154 of the forming ram assemblies 140 may all differ from stage to stage. For example, the first, third, fifth, etc., forming dies 154 may be the same while the second, fourth, sixth, etc., forming dies 154 may differ from the first, third, fifth, etc., forming dies. The forming die 154 in both an in-line and recirculating system may first neck the container and then expand the container along the system.

The knockout tool 152, which is coaxial with the forming die 154, helps to release containers from the forming die 154 after the forming die 154 necks each container. The knockout tool 152 catches a leading edge of the container while the container is being necked by the forming die 154 to prevent the container from having an irregular shape. Drive cylinder 146, which is selectively operable to cause axial movement of the knockout tool 152 within the forming die, is configured to operate independently of the forming die 154. The drive cylinder 146 includes an elongated, hollow drive cylinder shaft 160 that extends parallel to the drive shaft 110 of forming turret assembly 104. Bolt 162 extends into an opening in a proximal end of the forming die 154 and connects the knockout tool 152 to the drive cylinder shaft 160. A proximal end of knockout tool 152 contacts an inner surface of the container during the forming operation. Knockout tool drive cylinder shaft 160 is coaxial to and extends into a guide cylinder shaft 164. When the drive cylinder 146 receives air, e.g., via air input conduit 166, the drive cylinder shaft 160 moves axially with respect to forming die 154 due to incoming airflow that causes a differential pressure, thereby causing the knockout tool 152 to move, e.g., in the vertical direction, along the drive shaft 110. As the drive cylinder air shaft 160 receives air, air is passed into a container that interacts with the forming die 154 so that the container does not collapse upon itself when the shape of the container is modified by the forming die 154.

Figure 4:
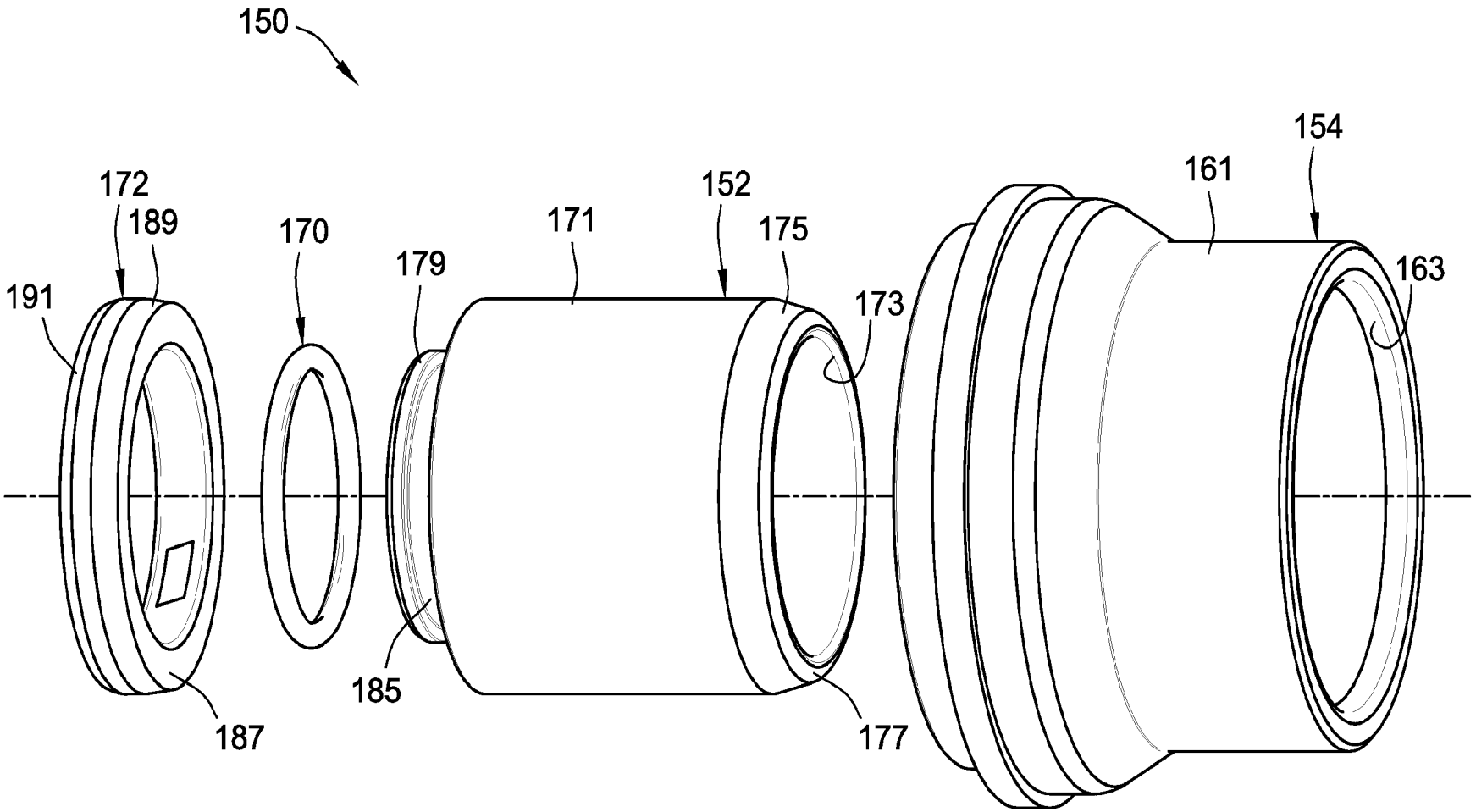
FIG. 4 is an exploded perspective-view illustration of a representative knockout and forming die subassembly with a knockout guide in accordance with aspects of the present disclosure.
Figure 5:
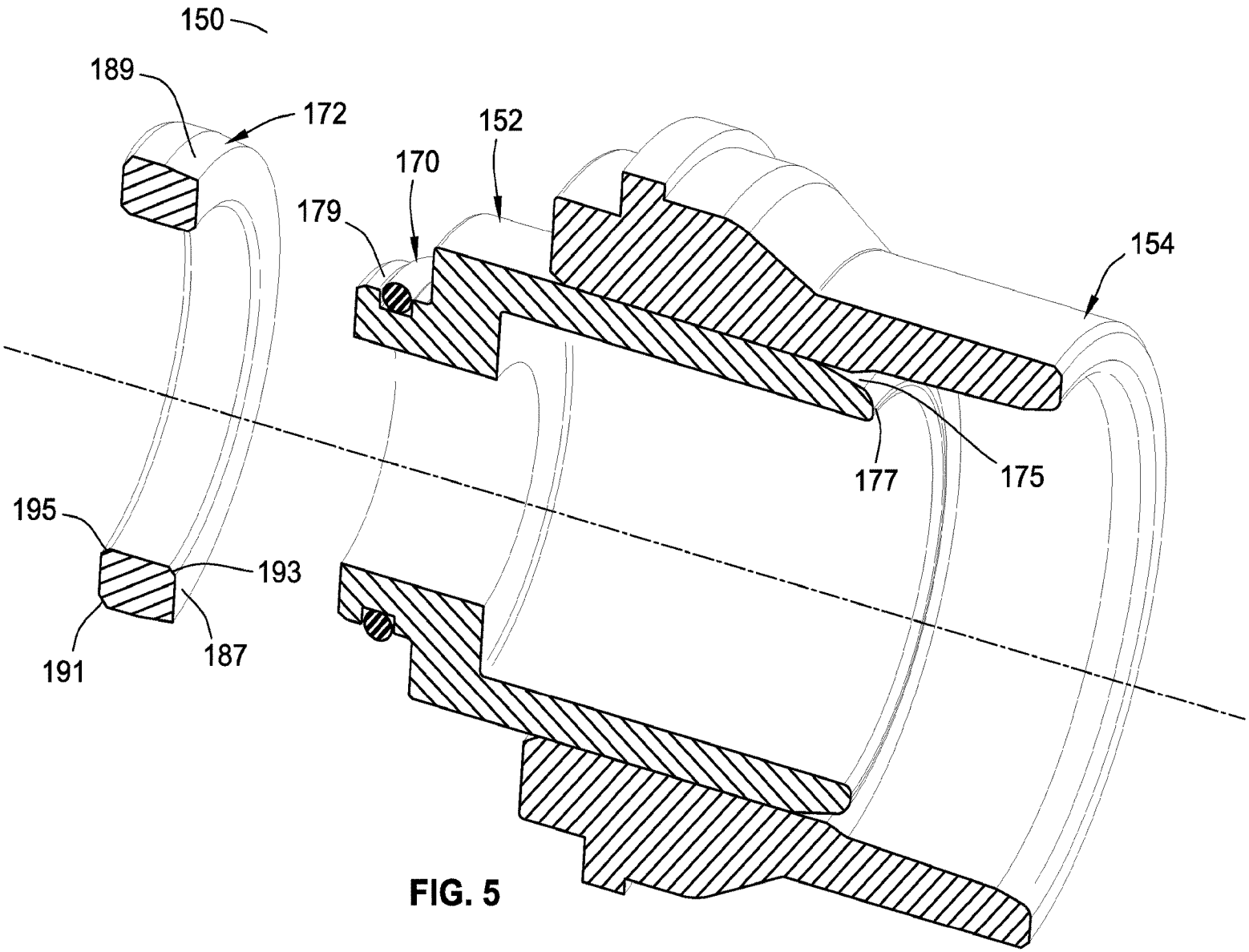
FIG. 5 is a partially exploded cross-sectional perspective-view illustration of the knockout and forming die subassembly of FIG. 4.
Figure 6:
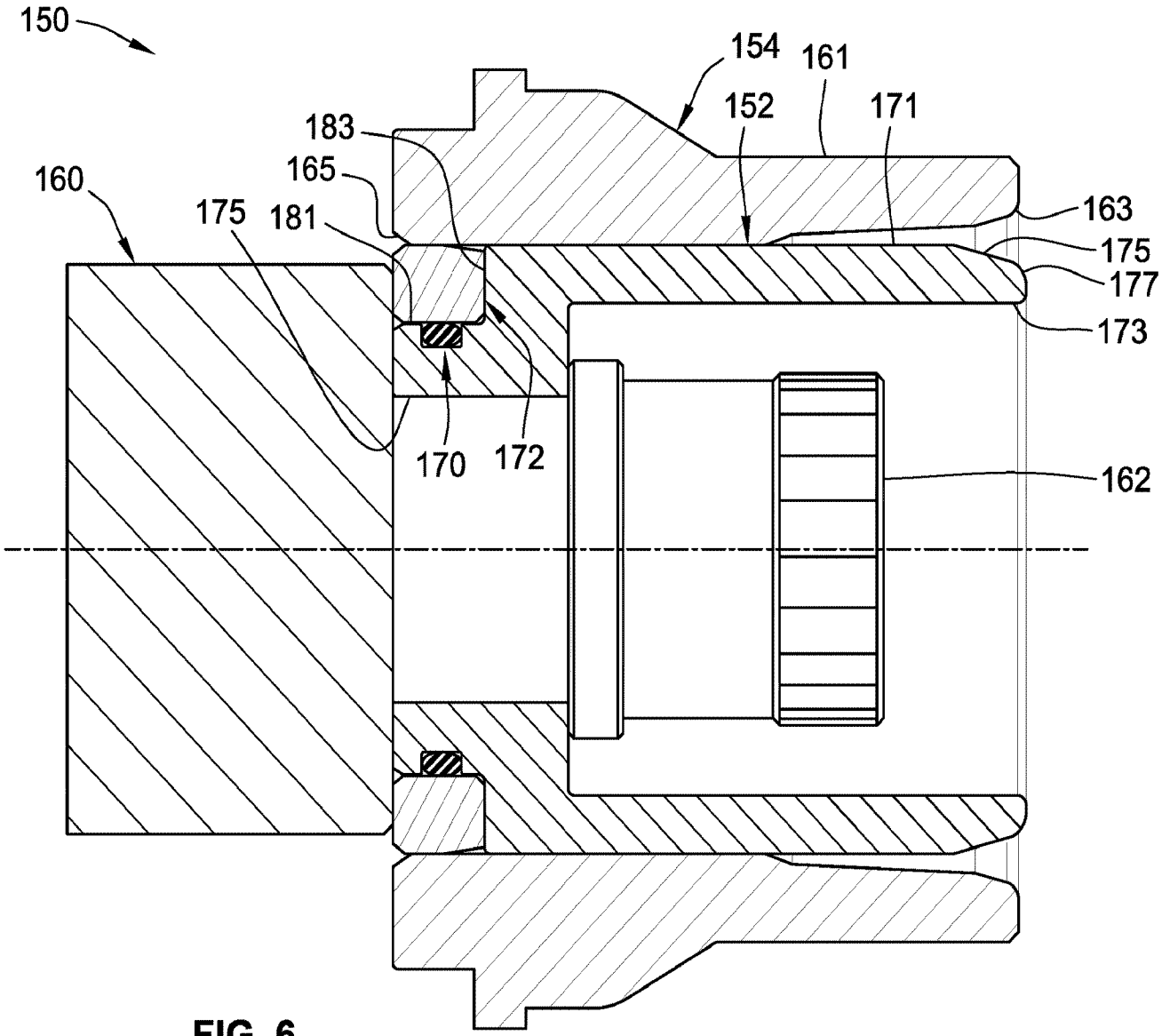
FIG. 6 is a cross-sectional side-view illustration of the knockout and forming die subassembly of FIG. 4 in cooperation with the drive cylinder shaft of the forming ram assembly of FIG. 3.

FIGS. 4 through 6 provide more detailed views of the knockout and forming die subassembly 150 of the forming ram assembly 140 presented in FIGS. 1 and 3. This subassembly 150 may be generally comprised of the knockout tool 152, the forming die 154, a polymeric O-ring 170, and a knockout guide 172. In the illustrated example, both the knockout tool 152 and forming die 154 have generally cylindrical geometries with hollow cores defined by concentrically aligned central through bores. A cylindrical body 161 of the forming die 154, which is portrayed as a single-piece unitary structure, has a contoured outer diameter (OD) surface that extends from a first proximal opening 163, into which an open end of a container is received, to a first distal opening 165, which seats inside a cylindrical mounting cuff 156 (FIG. 3) and receives therethrough the bolt 162. In this regard, a cylindrical body 171 of the knockout tool 152, which is also shown as a single-piece unitary structure, has a predominantly rectilinear outer diameter (OD) surface which extends from a second proximal opening 173, which is longitudinally spaced from the drive cylinder shaft 160, to a second distal opening 175, through which is received pressurized air from the drive cylinder shaft 160. It is also envisioned that the knockout tool 152 and forming die 154 take on other geometric configurations with alternative features from those shown in the drawings. By way of non-limiting example, the knockout tool and forming die bodies 161, 171 may be multi-part constructions and may have alternative OD profiles, for example, to accommodate a different application.

A leading edge of the knockout tool body 171 has a rounded nose 177 that leads to a forward-facing ramped surface 175. Rounded nose 177 extends continuously around the proximal opening 173 of the knockout tool 152 and functions to engage containers during each forming operation. At a rear end of the knockout tool body 171, formed on the OD surface of knockout tool 152 around the distal opening 175, is a stepped segment 179 for mating with the O-ring 170 and knockout guide 172. The stepped segment 179 is defined by a toroidal rim 181 that is generally perpendicular to a continuous flange wall 183. O-ring 170 is seated inside a complementary channel 185 that is defined in the stepped segment 179 of the knockout tool 152, recessed into the rim 181. This complementary channel 185 extends continuously around the OD surface of the knockout tool body 171. The knockout guide 172, in turn, is seated on the stepped segment 179 of the knockout tool 152, covering and concomitantly compressing the O-ring 170, as seen in FIG. 6. O-ring 170 of FIGS. 4-6 is an elastomeric toroidal joint with a circular cross-section; when compressed in the foregoing manner, the O-ring 170 functions as a mechanical gasket creating a fluid seal at the interface of the O-ring and guide.

According to the illustrated example, the knockout guide 172 is an annular, single-piece body 187 which extends continuously around the perimeter of the stepped segment 179 of knockout tool 152. It is desirable, for at least some embodiments, that the knockout guide 172 be fabricated from a polytetrafluoroethylene (PTFE) fluoropolymer compound or other wear-resistant, friction-reducing polymeric material. In cross-section, the knockout guide 172 has a polygonal geometry with flat primary and secondary sides, as best seen in FIG. 6. By way of example, the outer diameter (OD) surface of the knockout guide 172 includes an optional forward-facing ramped leading edge 189 that is obliquely angled, e.g., approximately 45-degrees, with respect to the inner diameter (ID) surface of the forming die 154. This ramped leading edge 189, which extends continuously around the circumference of the knockout guide 172, helps to ensure the knockout guide 173 remains in constant contact with the ID relief surface of the die 154. The OD trailing edge of the knockout guide 172, by comparison, has a trailing OD chamfered corner 191. Other optional features include leading and trailing ID chamfered corners 193 and 195, respectively, on the inner diameter (ID) surface of the knockout guide 172. These optional chamfered corners 193, 195 extend continuously around an inner perimeter of the knockout guide 172, and help to simplify mounting of the knockout guide 172 onto the knockout tool 152. It is also envisioned that the knockout guide 172 take on other shapes and cross-sections, be fabricated from other materials, and/or comprise a multi-segment body without departing from the scope of this disclosure.

With reference again to FIG. 6, the knockout guide 172 is shown located between and abutting the O-ring 170 and the ID surface of forming die 154. As shown, the knockout guide 172 is captured between a first (front) face of the drive cylinder shaft 160, a second (rear) face of the flange wall 183, and an third (outer) face of rim 181 of the knockout tool 152. The knockout guide 172 is press-fit onto the stepped segment 179 of the knockout tool 154. With this arrangement, mechanical fasteners and adhesives, while optional, are not required to maintain position of the knockout guide 172. In the illustrated example, the knockout guide 172 is located between and generally fluidly seals the knockout tool 152 and the forming die 154. This helps to minimize compressed air loss and prevent contaminants from entering thru the back of the tooling set. For at least some embodiments, the knockout guide 172 also functions as the dynamic wear component for reciprocating motion of the knockout with respect to the die. It is also envisioned that the knockout guide 172 replace the O-ring 170 such that the O-ring 170 is eliminated from the tooling assembly. In some alternative configurations, the locations of the knockout guide 172 and/or the O-ring 170 could be varied from that which is shown in the drawings.

The present invention is not limited to the precise construction and compositions disclosed herein; any and all modifications, changes, and variations apparent from the foregoing descriptions are within the spirit and scope of the invention as defined by the appended claims. Moreover, the present concepts expressly include any and all combinations and subcombinations of the preceding features and aspects.

What is claimed:

1. A forming ram assembly for a container forming machine, the container forming machine including a turret assembly with a cam rail, the forming ram assembly comprising:

a mounting rail configured to attach the forming ram assembly to the turret assembly of the container forming machine;

a cam follower indirectly coupled to the mounting rail and configured to traverse the cam rail of the turret assembly;

a forming die connected to the cam following such that the forming die moves in a reciprocating manner while the cam follower traverses the cam rail;

a knockout tool movably mounted inside the forming die, the knockout tool including an outer diameter (OD) surface with a stepped segment;

a drive cylinder connected to the knockout tool and configured to move the knockout tool in a reciprocating manner within the forming die;

an O-ring seated inside a complementary channel defined in the stepped segment of the knockout tool; and an annular knockout guide seated on the stepped segment of the knockout tool, located between and abutting the O-ring and the forming die.

2. The forming ram assembly of claim 1, wherein the knockout guide is press-fit onto the stepped segment, the knockout guide extending continuously around the outer diameter surface of the knockout tool.

3. The forming ram assembly of claim 1, wherein the knockout guide is fabricated as a single-piece polymeric structure.

4. The forming ram assembly of claim 1, Wherein the knockout guide includes an outer diameter (OD) surface with a forward-facing ramped leading edge extending continuously around a circumference of the knockout guide.

5. The forming ram assembly of claim 1, wherein the knockout guide includes an inner diameter (ID) surface with chamfered leading and trailing corners, the chamfered leading and trailing corners extending continuously around an inner perimeter of the knockout guide.

6. The forming ram assembly of claim 1, wherein the stepped segment extends continuously around a circumference of the knockout tool.

7. The forming ram assembly of claim 1, wherein the knockout guide is captured between a front face of the drive cylinder and a rear face of the knockout tool.

8. The forming ram assembly of claim 1, further comprising an adapter arm coupled to a bracket, the bracket being coupled to the cam rail, the cam followers being mounted to the adapter arm.

9. A forming apparatus for modifying a shape of a container, the forming apparatus comprising:

a frame with a first base and a second base;

a drive shaft extending from the first base to the second base;

a turret starwheel coaxially mounted with the drive shaft and configured to receive and move the container;

a turret assembly coaxially mounted with the drive shaft, the turret assembly including an elongated cam rail; and a forming ram assembly connected to the turret assembly, the forming ram assembly including:

a cam follower movably seated against the elongated cam rail;

a forming die connected to the cam follower such that the forming die moves in a reciprocating manner as the cam follower traverses the elongated cam rail;

a knockout tool movably mounted inside the forming die, the knockout tool including an outer surface with a stepped segment;

a drive cylinder connected to the knockout tool and configured to move the knockout tool in a reciprocating manner relative to the forming die;

an O-ring seated inside a complementary channel defined in the stepped segment of the knockout tool; and a knockout guide seated on the stepped segment of the knockout tool, abutting the O-ring and the forming die.

10. The forming apparatus of claim 9, wherein the knockout guide is annular, extending continuously around a circumference of the knockout tool.

11. The forming apparatus of claim 9, wherein the knockout guide is press-fit onto the stepped segment of the knockout tool.

12. The forming apparatus of claim 9, wherein the knockout guide is fabricated from a polytetrafluoroethylene (PTFE) material.

13. The forming apparatus of claim 9, wherein the knockout guide consists essentially of a single-piece polymeric structure.

14. The forming apparatus of claim 9, wherein the knockout guide includes an outer surface with a forward-facing ramped leading edge.

15. The forming apparatus of claim 14, wherein the knockout guide is annular, the ramped leading edge extending continuously around a circumference of the knockout guide.

16. The forming apparatus of claim 9, wherein the knockout guide includes an inner surface with chamfered leading and trailing corners.

17. The forming apparatus of claim 16, wherein the knockout guide is annular, the chamfered corners extending continuously around an inner perimeter of the knockout guide.

18. The forming apparatus of claim 9, wherein the knockout guide is located between and fluidly seals the O-ring and the forming die.

19. The forming apparatus of claim 9, wherein the knockout tool is cylindrical, the stepped segment extending continuously around a circumference of the knockout tool.

20. The forming apparatus of claim 9, wherein the knockout guide is captured between a front face of the drive cylinder and a rear face of the knockout tool.

* * * * *